US005898360A

United States Patent [19]

Lim

[11] Patent Number: 5,898,360

[45] Date of Patent: Apr. 27, 1999

[54] HEATER FOR HEATING AN AUTOMOBILE SENSOR

[75] Inventor: Chang-bin Lim, Seoul, Rep. of Korea

[73] Assignee: Samsung Electro Mechanics, Co., Ltd., Kyungki-Do, Rep. of Korea

[21] Appl. No.: 08/871,491

[22] Filed: Jun. 10, 1997

Related U.S. Application Data

[63] Continuation of application No. 08/549,313, Oct. 27, 1995, abandoned.

[30] Foreign Application Priority Data

Dec. 26, 1994 [KR] Rep. of Korea ..... 94-36928

[51] Int. Cl.[6] ..... H01C 1/02

[52] U.S. Cl. ..... 061097/338; 338/307; 338/204; 219/543

[58] Field of Search ..... 338/306, 307, 338/204, 254, 255, 34; 219/543

[56] References Cited

U.S. PATENT DOCUMENTS

| | | | |
|---|---|---|---|
| 3,610,888 | 10/1971 | Button | 219/543 |
| 3,914,169 | 10/1975 | Horowitz | 204/195 |
| 4,187,486 | 2/1980 | Takahashi et al. | 338/34 |
| 4,242,302 | 12/1980 | Kitamura et al. | 422/94 |
| 4,296,309 | 10/1981 | Shimmi et al. | 347/204 |
| 4,592,967 | 6/1986 | Komatsu et al. | 428/697 |
| 4,806,739 | 3/1989 | Kojima etal. | 219/488 |
| 4,883,947 | 11/1989 | Mulrase et al. | 219/553 |
| 4,952,903 | 8/1990 | Shibata et al. | 338/34 |
| 5,001,089 | 3/1991 | Kasori et al. | 501/192 |
| 5,019,891 | 5/1991 | Onuki et al. | 357/70 |
| 5,035,779 | 7/1991 | Nishiki et al. | 204/98 |
| 5,063,192 | 11/1991 | Murakami et al. | 502/303 |
| 5,066,626 | 11/1991 | Fukao et al. | 501/152 |
| 5,200,384 | 4/1993 | Funabiki et al. | 502/304 |
| 5,753,893 | 5/1998 | Noda et al. | 219/548 |

*Primary Examiner*—Michael L. Gellner
*Assistant Examiner*—Karl Easthom
*Attorney, Agent, or Firm*—Foley & Lardner

[57] ABSTRACT

A ceramic heater for a gas sensor has a heater substrate, a laminating substrate made of the same material as the heater substrate, and an electrode made of platinum and at least one lanthanide oxide disposed between the heater substrate and the laminating substrates. The ceramic heater exhibits improved durability without migration patterns, is free of cracks on the substrate, is free of short circuits in the heat electrode and is low in production cost.

13 Claims, 3 Drawing Sheets

HEATER FOR HEATING AN AUTOMOBILE SENSOR

This application is a continuation of application Ser. No. 08/549,313, filed Oct. 27, 1995, now abandoned.

BACKGROUND OF THE INVENTION

1. Field of the invention

The present invention relates, in general, to a heater for heating an automobile sensor and, more particularly, to an improvement in durability along with the heater and the ceramic heater.

2. Description of the Prior Art

Owing to superior endurance at high temperature, ceramic heaters are useful for a plurality of purposes, especially, for automobile sensors. An automobile has a solid electrolyte air/fuel (A/F) sensor for detecting the oxygen content contained in an exhaust gas from the engine, in order to purify the exhaust gas and to enhance the fuel consumption ratio. Such sensor can respond only when it is heated to at least about 800 degrees centigrade.

For the respondence, a heater is adopted to elevate the temperature. The heater is generally made by constructing an electrode on a substrate with high thermal conductivity. The electrode consists typically of platinum in combination with additives. Recently, there has been a strong demand for low-resistant heaters which are capable of elevating temperature more rapidly. The low resistance can be accomplished by incorporating a variety of ceramic powders in the heater.

When $Al_2O_3$, a typical material for the substrate, is sintered, sinter-aiding agents and/or grain-growth inhibitors are usually added because of its high sintering temperature Oxides, such as $SiO_2$, MgO, CaO and the like, are used as these additives because it is easy for them to make $Al_2O_3$glassy upon sintering. Other additives exist for these purposes. For example, oxides of Periodic Table Group III*a* metal, for example, $Y_2O_3$, are added for reducing the sintering temperature and $ZrO_2$ for inhibiting grain growth of $Al_2O_3$. However, heaters employing such $Al_2O_3$ substrates, when used at high temperature under direct current high voltage (e.g. automobile power 12V), allow the alkaline metal ions contained in the substrates, that is, $Mg^{2+}$, $Ca^{2+}$, to migrate into the negative terminal and thereby to give rise to segregation. As a result, compounds with low melting points are produced, which cause cracks on the surface of the heater and thus, short circuits in the heater electrode.

In order to prevent the migration, a variety of techniques have been undertaken, e.g. high purity of $Al_2O_3$ or small amount of $Al_2O_3$in Pt. However, these techniques can relieve the migration only to some degree and the purer $Al_2O_3$requires a higher sintering temperature.

Referring to FIG. 1, there is shown a heater which is presently commercially available. As shown in this figure, it consists of two laminating substrates 1, 5 between which a migration pattern 2, a heater substrate 3 and a heater electrode 4 are, in sequence, formed. The migration pattern 2 is interposed between the laminating substrate 1 and the heater substrate 3, with the aim of preventing the generation of cracks on the heater substrate 3 and short circuits in the heater electrode 4. This heater, however, is disadvantageous in that its construction is done by complicated processes, which results in high production cost.

SUMMARY OF THE INVENTION

It is therefore an object of the present invention to provide a heater for heating an automobile sensor, preventive of migration of alkaline metal ions into negative terminal in the heater.

It is another object of the present invention to provide a heater for heating an automobile sensor, in which durability can be improved without migration pattern.

It is a further object of the present invention to provide a heater for heating an automobile sensor, free of cracks on the substrate and short circuits in the heat electrode.

It is still another object of the present invention to provide a heater for heating an automobile sensor, having a simple duplicate structure which is low in production cost.

In accordance with an aspect of the present invention, there is provided a heater comprising a heating electrode comprised of platinum and at least one of lanthanide oxides.

In accordance with another aspect of the present invention, there is provided a heater comprising a heating electrode comprised of platinum and cerium oxide.

In accordance with another aspect of the present invention, there is provided a heater for heating an automobile sensor, comprising a heater substrate; an electrode comprised of platinum and at least one of lanthanide oxides; and a laminating substrate comprised of a same material as said heater substrate; and wherein said electrode is disposed between said heater substrate and said laminating substrate.

BRIEF DESCRIPTION OF THE DRAWINGS

The above objects and other features and advantages of the present invention will be more apparent from the following detailed description taken with reference to the accompanying drawings, in which.

DETAILED DESCRIPTION OF THE INVENTION

In accordance with the present invention, an oxide of lanthanides is added in a platinum electrode formed on an $Al_2O_3$ substrate and, optionally, in the $Al_2O_3$ substrate. The resulting ceramic heater can be preventive of migration of the alkaline metal ions into negative terminal therein, without employing a migration pattern.

Figure 1:
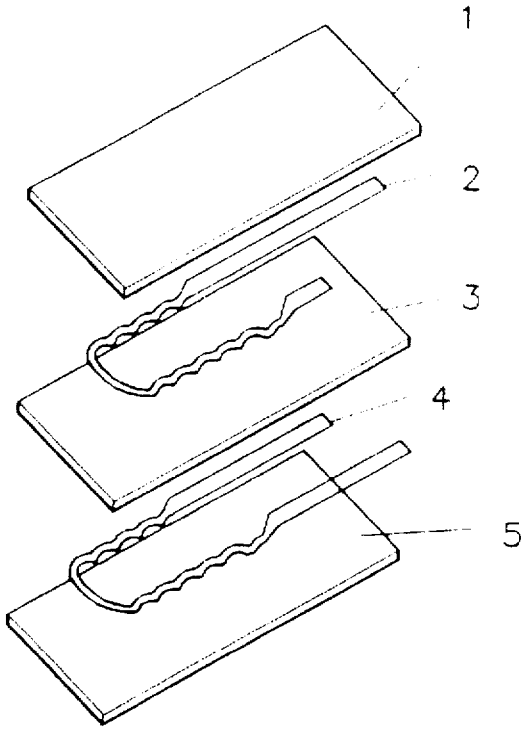
FIG. 1 (PRIOR ART)
FIG. 1 is an exploded perspective view showing a conventional ceramic heater for automobile air/fuel sensor.
Figure 2:
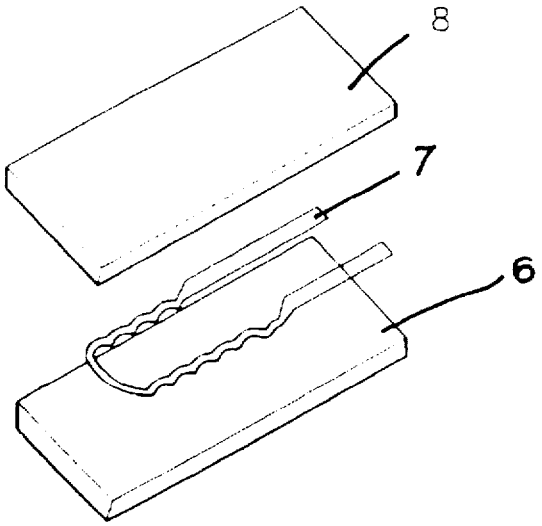
FIG. 2 is an exploded perspective view showing a ceramic heater for automobile air/fuel sensor, according to the present invention.

This application of the preferred embodiments of the present invention will be best understood by referring to the accompanying drawings First, with reference to FIG. 2, there is shown a ceramic heater, according to the present invention. As shown in this figure, it has a duplicate structure consisting of a heater substrate 6 and a laminating substrate 8 between which a heater electrode 7 is formed.

A green sheet of the heater substrate is prepared from a formulation comprising particles of a mixture of $Al_2O_3$, CaO, $Sio_2$ and MgO (average diameter 0.5 μm), a sintering agent of YSZ and a PVB based binder, using a doctor blade process.

For heater electrode 7, a paste which is prepared by adding $CeO_2$ and a PVB-based binder to platinum is screen printed on the green sheet of heater substrate 6. The lanthanides oxide can play a key role in preventing the positive ions, $Ca^2$+, $Mg^2$+from migrating into the negative terminal and have little adverse influence on the conductivity of platinum by virtue of its superior conductivity. In addition, they can increase the adhesive strength of heater electrode 7 to heater substrate 6. $CeO_2$, an oxide capable of storing oxygen, can provide oxygen continuously so as to prevent the generation of positive ions, $Mg^{2+}$, $Ca^{2+}$ in the heater electrode.

Figure 3:
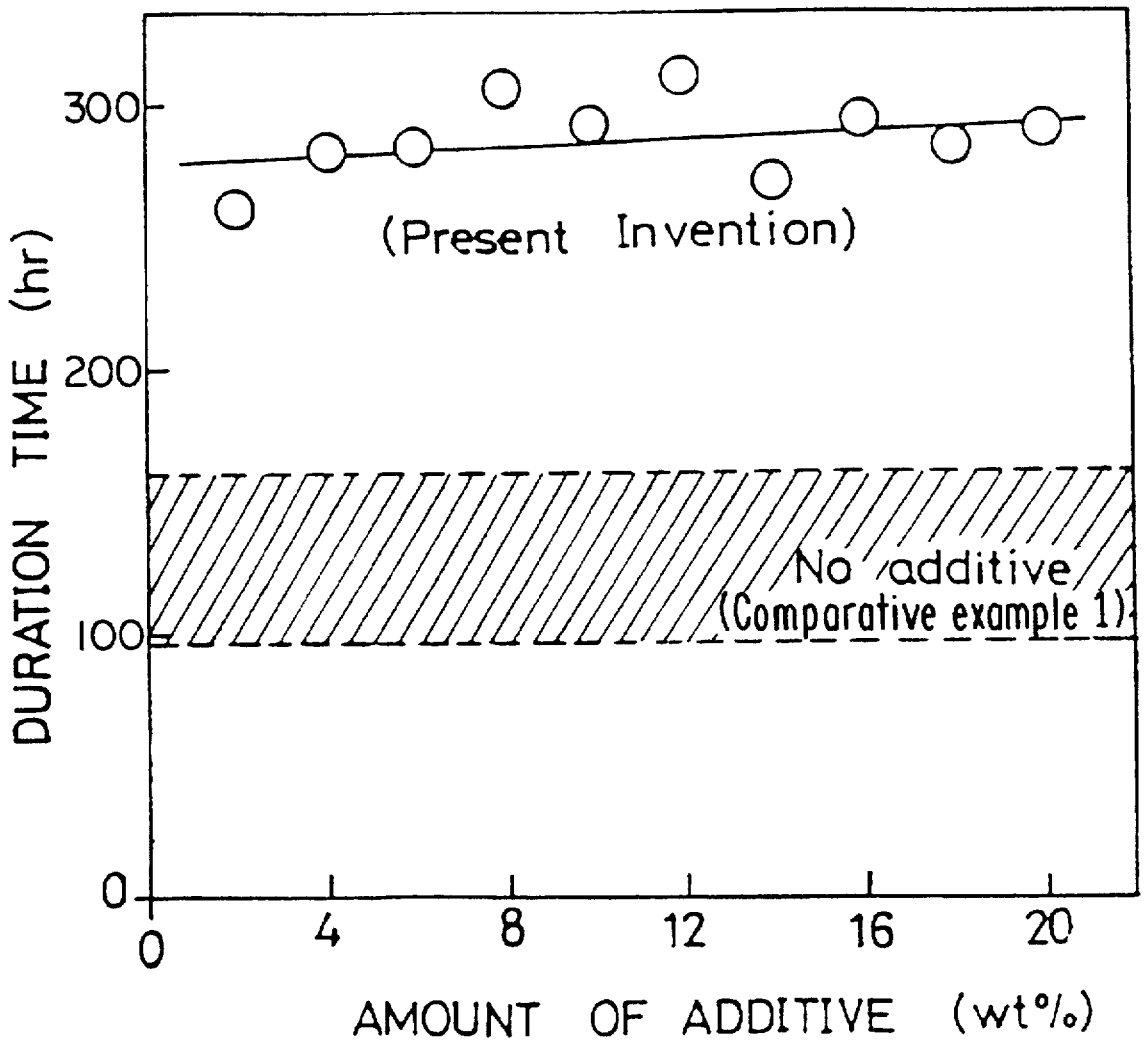
FIG. 3 is a graph showing the durability [vs. additive amount of a ceramic heater for automobile air/fuel sensor of the present invention and a conventional one with 3.5 ohm of resistance respectively;] of a heater of the present invention as a function of the amount of a lanthanide oxide added to the heater and the durability of a conventional heater that does not contain any lanthanide oxide, both heaters having a resistance of 3.5 ohms.

In accordance with the present invention, the lanthanides oxide is added in an amount of about 3 to about 20% by weight, based on the weight amount of platinum and preferably about 8 to about 12% by weight. For example, as shown in FIG. 3, if too much lanthanides oxide is used, the resulting platinum electrode is difficult to sinter, as will be described shortly. On the other hand, if too little lanthanides oxide is used, there is little effect of preventing the migration. In the paste, the PVB-based binder ranges in quantity from about 5 to about 50% by weight of the paste.

Another green sheet is prepared in the same manner as in the heater substrate and used as a laminating substrate which overlays the heater substrate. The duplicate structure thus obtained is sintered at a temperature of about 1,500° C. for about an hour, to give a ceramic heater.

Optionally, $CeO_2$ may be added to each of the heater substrate and the laminating substrate in up to 20% by weight of platinum in the heater electrode, with the aim of strengthening the above-mentioned effects.

As explained above, the ceramic heater of the present invention adopts a duplicate structure, which is much simpler than the conventional multiplicate structure, e.g. triplicate structure. Use of an appropriate amount of $CeO_2$ as an additive for the heater electrode restrains the migration, even though the ceramic heater is used at high temperatures under the application of high direct current voltages (e.g. 10 to 13 V), because the ability of $CeO_2$ to store oxygen allows oxygen to be provided so constantly as to prevent generation of the alkaline metal ions, $Ca^{2+}$, $Mg^{2+}$, in the $Al_2O_3$ substrate. Accordingly, there is obtained an effect of preventing short circuits in the electrode and cracks on the substrate, in accordance with the present inventions. In addition, since $CeO_2$ readily forms a solid solution with $Al_2O_3$, CaO, $Sio_2$, MgO and the like, the heater electrode becomes anchored to the heater substrate, reinforcing the adhesive strength therebetween.

A better understanding of the present ceramic heater may be obtained in light of following examples which are set forth to illustrate, and are not to be construed to limit, the present invention.

EXAMPLE I

Particles (average diameter 0.5 μm) of a mixture consisting of 96 weight percent $Al_2O_3$, 0.6 weight percent CaO, 2.4 weight percent $SiO_2$ and 1 weight percent of MgO were added with a sintering agent of 6 mole percent YSZ in an amount of 1 weight percent of the particles and then, mixed with a PVB based binder such as that sold by Sekisui Co. Ltd., Japan under the trademark designation "BMS", in an amount of 10 weight percent of the particles. The resulting mixture was formed into a green sheet with a dimension of 5mm×50mm×0.8mm by a doctor blade process.

Platinum was formulated with 3 weight percent $CeO_2$ to 20 weight percent PVB based binder, to give a paste which was then screen printed on the green sheet.

Another green sheet with a dimension of 5mm×50mm×0.4mm which was prepared in the same manner as that for the above green sheet was laminated thereon. The resulting laminate was subjected to sintering at about 1,500° C. for about an hour in the air, to give a ceramic heater.

EXAMPLE II

A ceramic heater was prepared in the similar manner to that of Example I, except that the amount of $CeO_2$ was 20 weight percent based on the weight of platinum.

EXAMPLE III

Particles (average diameter 0.5 μm) of a mixture consisting of 96 weight percent $Al_2O_3$, 0.6 weight percent CaO, 2.4 weight percent $SiO_2$ and 1 weight percent of MgO were added with a sintering agent of 6 mole percent YSZ in an amount of 1 weight percent of the particles and then, mixed with a PVB based binder such as that sold by Sekisui Co. Ltd., Japan under the trademark designation "BMS", in an amount of 6 weight percent of the particles. The resulting mixture was formed into a green sheet with a dimension of 5mm×50mm×0.8mm by a doctor blade process.

Platinum was formulated with 6 weight percent $CeO_2$ and 10 weight percent PVB based binder, to give a paste which was then screen printed on the green sheet.

Another green sheet with a dimension of 5mm×50mm×0.4mm which was prepared in the same manner as that for the above green sheet was laminated thereon. The resulting laminate was subjected to sintering at about 1,500° C. for about an hour in the air, to give a ceramic heater.

Comparative Example I

A ceramic heater was prepared in the similar manner to that of Example, except that $CeO_2$ was not added.

Figure 4:
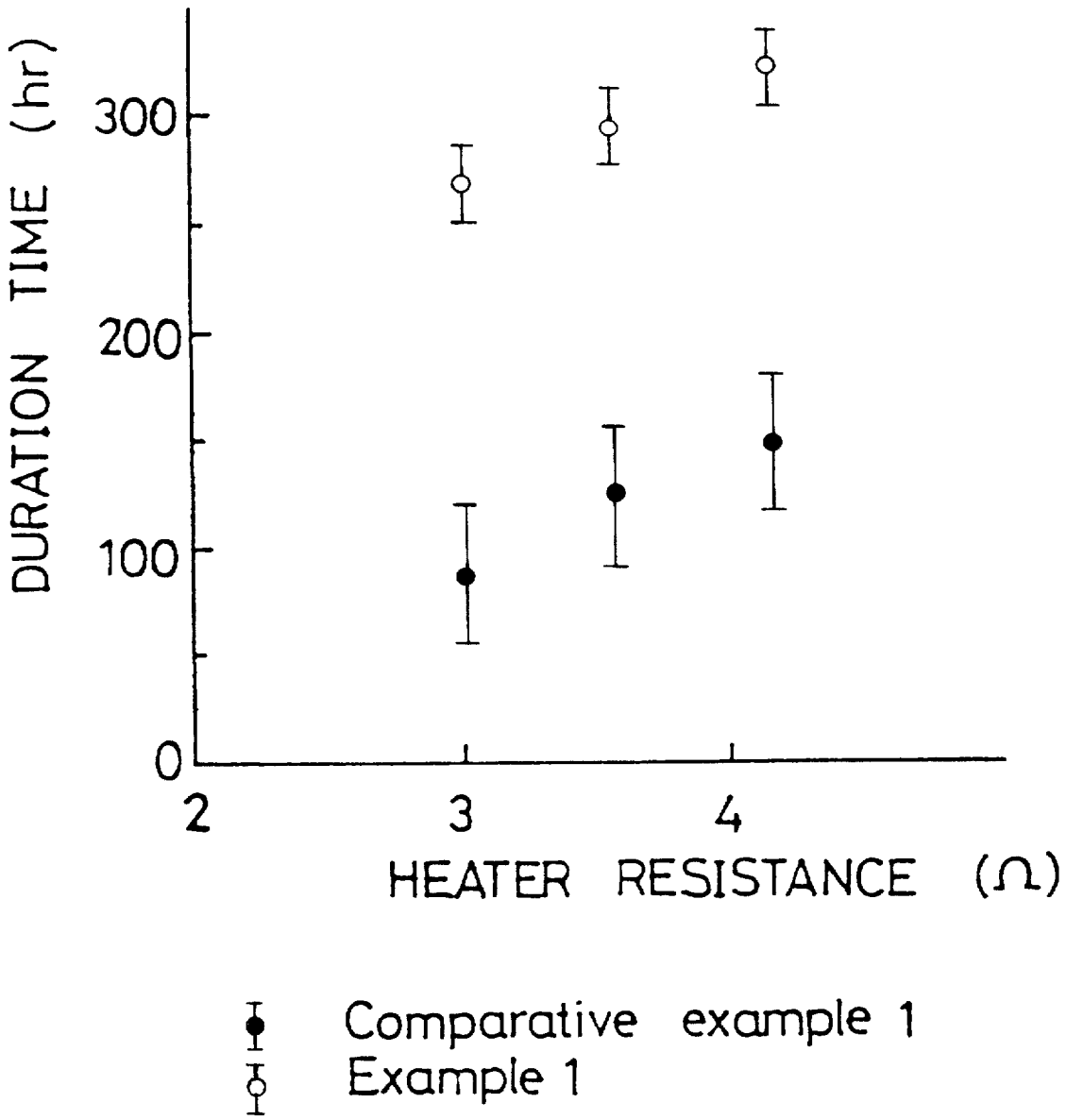
FIG. 4 is a graph showing durability of a ceramic heater for automobile air/fuel sensor of the present invention and a conventional one.

The ceramic heaters obtained in Example I and Comparative Example I were tested for durability. For this test, heater resistance was confined to a range of 3 to 4 ohms and a severe condition of 1,000° C. was taken by applying a voltage of 12.5 to 13.5 V. Results are given as shown in FIGS. 3 and 4 in which duration time is plotted with respect to additive amounts and heater resistance, respectively. As apparent from this plot, the ceramic heater containing $CeO_2$ (represented by solid lines) shows much longer duration time than that devoid of $CeO_2$ (represented by dotted lines), averaging 270 hours. This is owing to reduction in the migration. Particularly, the quite narrow distribution of the measured times demonstrates superiority in reproductivity and reliability. Further, the higher resistance, the longer duration time. From these results, it is proved that addition of $CeO_2$ in the electrode brings about an effect of prolonging duration time.

As described hereinbefore, $CeO_2$ can readily form a solid solution with the MgO, CaO, $SiO_2$ and $Al_2O_3$, resulting in an excellent adhesion of the platinum electrode to the $Al_2O_3$ substrate. In addition, the lanthanides oxide restrains the migration of the alkaline metal ions, $Mg^{2+}$, $Ca^{2+}$ owing to its superior protector and oxygen-storing ability, thereby preventing short circuit of the heat electrode as well as cracks on the $Al_2O_3$ substrate. Further, the present ceramic heater has a duplicate structure free of the conventional migration pattern, which greatly contributes to simplification of production process and to reduction of production cost.

Other features, advantages and embodiments of the present invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

What is claimed is:

1. A ceramic heater consisting essentially of:

a heater substrate, a heating element and a laminating substrate;

wherein the heater substrate comprises $Al_2O_3$ and at least one compound selected from the group consisting of MgO, CaO, and $SiO_2$;

wherein the heating element comprises a mixture of platinum and at least one lanthanide oxide additive;

and wherein the heating element is disposed between the heater substrate and the laminating substrate.

2. The heater as claimed in claim 1, wherein said laminating substrate is comprised of the same material as said heater substrate.

3. The heater as claimed in claim 1, wherein said at least one lanthanide oxide is present in an amount of about 3 to 20 weight percent based on the weight of platinum.

4. The heater as claimed in claim 1, wherein said at least one lanthanide oxide is present in an amount of about 8 to 12 weight percent based on the weight of platinum.

5. The heater as claimed in claim 1, wherein said at least one lanthanide oxide is cerium oxide.

6. The heater as claimed in claim 5, wherein said cerium oxide is present in an amount of about 3 to 20 weight percent based on the weight of platinum.

7. The heater as claimed in claim 6, wherein said cerium oxide is present in an amount of about 8 to 12 weight percent based on the weight of platinum.

8. The heater as claimed in claim 1, wherein said heater substrate and said laminating substrate contain at least one lanthanide oxide.

9. The heater as claimed in claim 8, wherein said at least one lanthanide oxide contained in said heater substrate and in said laminating substrate is present in an amount of less than 20 weight percent based on the weight of platinum in the heater electrode.

10. A ceramic heater comprising:

a heater substrate comprised of $Al_2O_3$ and at least one compound selected from the group consisting of MgO, CaO, and $SiO_2$;

a heating element comprised of a mixture of platinum and at least a cerium oxide additive, and a laminating substrate;

wherein the heating element is disposed between the heater substrate and the laminating substrate; and wherein said heater substrate and said laminating substrate contain cerium oxide.

11. The heater as claimed in claim 10, wherein said cerium oxide contained in said heater substrate and in said laminating substrate is present in an amount of less than 20 weight percent based on the weight of platinum in the heater electrode.

12. A ceramic heater comprising:

a heater substrate;

a heating element comprised of a mixture of platinum and at least one lanthanide oxide additive; and a laminating substrate, wherein the heating element is disposed between the heater substrate and the laminating substrate, and wherein at least one of the heater substrate and the laminating substrate contain at least one lanthanide oxide additive.

13. The ceramic heater as claimed in claim 12, wherein the lanthanide oxide additive is cerium oxide.

* * * * *